US005625744A

United States Patent [19]

Ozawa

[11] Patent Number: 5,625,744

[45] Date of Patent: Apr. 29, 1997

[54] SPEECH PARAMETER ENCODING DEVICE WHICH INCLUDES A DIVIDING CIRCUIT FOR DIVIDING A FRAME SIGNAL OF AN INPUT SPEECH SIGNAL INTO SUBFRAME SIGNALS AND FOR OUTPUTTING A LOW RATE OUTPUT CODE SIGNAL

[75] Inventor: Kazunori Ozawa, Tokyo, Japan

[73] Assignee: NEC Corporation, Tokyo, Japan

[21] Appl. No.: 193,596

[22] Filed: Feb. 9, 1994

[30] Foreign Application Priority Data

Feb. 9, 1993 [JP] Japan ..... 5-021026

[51] Int. Cl.[6] ..... G10L 9/14; G10L 9/02; G10L 9/18

[52] U.S. Cl. ..... 395/2.31; 395/2.38; 395/2.39; 395/2.74

[58] Field of Search ..... 395/2.3, 2.31, 395/2.32, 2.38, 2.39, 2.73, 2.74

[56] References Cited

FOREIGN PATENT DOCUMENTS

| | | | |
|---|---|---|---|
| 0501421 | 2/1992 | European Pat. Off. | 395/2.31 |
| 0501421 | 9/1992 | European Pat. Off. . | |
| 0514912 | 11/1992 | European Pat. Off. . | |
| 0545386 | 6/1993 | European Pat. Off. . | |

OTHER PUBLICATIONS

Linde et al., "An Algorithm for Vector Quantizer Design", *IEEE Transactions on Communications,* vol. Com-28, No. 1, pp. 84–95 (Jan. 1980).

Schroeder et al., "Code-Excited Linear Prediction (CELP): High-Quality Speech at Very Low Bit Rates", *IEEE,* Proceedings of ICASSP, pp. 937–940 (1985).

Tsao et al., "Matrix Quantizer Design for LPC Speech Using the Generalized Lloyd Algorithm", *IEEE Transaction on Acoustics, Speech, and Signal Processing,* vol. ASSP-33, No. 3, pp. 537–545 (Jun. 1985).

Kleijn et al., "Improved Speech Quality and Efficient Vector Quantization in SELP", *IEEE,* Proceedings of ICASSP, pp. 155–158 (1988).

Moriya et al., "Transform Coding of Speech Using a Weighted Vector Quantizer", *IEEE Journal on Selected Areas in Communications,* vol. 6, No. 2, pp. 425–431 (Feb. 1988).

Sugamura et al., "Quantizer Design in LSP Speech Analysis-Synthesis", *IEEE Journal on Selected Areas in Communications,* vol. 6, No. 2, pp. 432–440 (Feb. 1988).

Laroia et al., "Robust and Efficient Quantization of Speech LSP Parameters Using Structured Vector Quantizers", *IEEE,* Proceedings of ICASSP, pp. 641–644 (May 1991).

Paliwal et al., "Efficient Vector Quantization of LPC Parameters at 24 Bits/Frame", *IEEE Transactions on Speech and Audio Processing,* vol. 1, No. 1, pp. 3–14 (Jan. 1993).

*Primary Examiner*—Allen R. MacDonald
*Assistant Examiner*—Tálivaldis Ivars Ŝmits
*Attorney, Agent, or Firm*—Foley & Lardner

[57] ABSTRACT

On encoding with a smallest possible number of bits LPC parameters produced by an LPC analyzer from at least one of subframe signals of each frame signal of an input speech signal, a divider divides the LPC parameters into several parameter regions. Using vector code books loaded for each parameter region with code vectors, a vector quantizer quantizes the LPC parameters into, for use as quantized codes, indexes of selected vectors which are selected from the code vectors and of which a linear combination minimizes a quantization distortion.

8 Claims, 3 Drawing Sheets

SPEECH PARAMETER ENCODING DEVICE WHICH INCLUDES A DIVIDING CIRCUIT FOR DIVIDING A FRAME SIGNAL OF AN INPUT SPEECH SIGNAL INTO SUBFRAME SIGNALS AND FOR OUTPUTTING A LOW RATE OUTPUT CODE SIGNAL

BACKGROUND OF THE INVENTION

This invention relates to a speech parameter encoding device for encoding spectrum parameters of an input speech or voice signal at a low bit rate, such as below 4.8 kb/s.

For use in encoding an input speech signal at a low bit rate of less than 8 kb/s, a code excited LPC coding (CELP) is already known. Examples are disclosed in a paper contributed by M. R. Schroeder and B. S. Atal to the Proceedings of ICASSP, 1985, pages 937 to 940, under the title of "Code-excited Linear Prediction (CELP): High-Quality Speech at Very Low Bit Rates" and in another paper contributed by W. B. Kleijn and two others to the Proceedings of ICASSP, 1988, pages 155 to 158, under the title of "Improved Speech Quality and Efficient Vector Quantization in SELP".

According to the code excited LPC coding, spectrum parameters are extracted from each frame signal of an input speech signal. The frame signal has a frame length which may be 20 milliseconds long. The spectrum parameters represent spectrum characteristics of the input speech signal. The frame signal is divided into subframe signals, each having a subframe length of, for example, 5 milliseconds. Based on the subframe signal of a previous subframe, pitch parameters are extracted to represent a long-time or pitch correlation. Using the pitch parameters in long-term predicting the subframe signals, residue signals are calculated. Code books are used to define noise signals of predetermined kinds. For the residue signals, noise signals are selected from the code books. One of the predetermined kinds is selected to minimize an error power between the input speech signal and a combination of such noise signals and to calculate an optimum gain. The spectrum parameters and the pitch parameters are transmitted together with the optimum gain and an index indicative of the above-mentioned one of the predetermined kinds.

In the code excited LPC coding, LPC analysis is used in calculating LPC parameters as the spectrum parameters. The LPC parameters are quantized usually in accordance with scalar quantization. When LPC coefficients are used up to a tenth degree for quantization, it is necessary to use a bit number of 34 bits per frame. This bit number results in a bit rate of 1.7 kb/s in encoding only the LPC coefficients. A reduction in the bit number has given rise to a deteriorated quality.

In order to more effectively quantize the LPC parameters, vector-scalar quantization is proposed. An example is revealed in a paper contributed by Takehiro Moriya and another to the IEEE Journal of Selected Areas in Communications, 1988, pages 425 to 431, under the title of "Transform Coding of Speech Using a Weighted Vector Quantizer". Even with this quantization, the bit number must be from 27 to 30 bits.

When a longer frame length is used, a smaller bit number would be used in quantizing the spectrum parameters. This has, however, made it difficult to excellently represent a time variation within the frame in the spectrum characteristics and resulted in an increased distortion and in a deteriorated speech quality.

Later in the following, four other papers will be referred to. One is contributed by Noboru Sugamura and another to the IEEE Journal of Selected Areas in Communications, 1988, pages 432 to 440, under the title of "Quantizer Design in LSP Speech Analysis-Synthesis". Another is contributed by Yoseph Linde and two others to the IEEE Transactions on Communications, 1980, pages 84 to 95, under the title of "An Algorithm for Vector Quantization Design". A like paper is contributed by K. K. Paliwal and another to the IEEE Transactions on Speech and Audio Processing, 1993, pages 3 to 14, under the title of "Efficient Vector Quantization of LPC Parameters at 24 Bits/Frame". Still another is contributed by Chieh Tsao and two others to the IEEE Transactions on ASSP, 1985, pages 537 to 545, under the title of "Matrix Quantizer Design for LPC Speech Using the Generalized Lloyd Algorithm". Yet another is contributed by Laroia and two others to the Proceedings of ICASSP, 1991, pages 641 to 644, under the title of "Robust and Efficient Quantization of Speech LSP Parameters Using Structured Vector Quantizers".

SUMMARY OF THE INVENTION

In consideration of the problems in the prior art, it is an object of the present invention to provide a speech parameter encoding device capable of encoding spectrum parameters with a small bit number.

It is another object of this invention to provide a speech parameter encoding device which is of the type described and which can achieve an excellent speech quality.

Other objects of this invention will become clear as the description proceeds.

In accordance with this invention, there is provided a speech parameter encoding device which includes a dividing circuit for dividing each frame signal of an input speech signal into a plurality of subframe signals and which comprises: (A) a spectrum parameter calculating unit for calculating spectrum parameters for at least one of the subframe signals up to a predetermined degree; (B) a dividing unit for dividing the spectrum parameters by a predetermined region number into parameter regions; (C) vector code books, a plurality of stages in number, each code book defining a plurality of code vectors for each of the parameter regions; (D) a quantizer unit for quantizing the spectrum parameters of the parameter regions into quantized codes by selecting the code vectors as selected vectors from the code books with each of the quantized codes calculated from a linear combination of the selected vectors; and (E) an output unit for producing the quantized codes as an output code signal.

DESCRIPTION OF THE PREFERRED EMBODIMENTS

Figure 1:
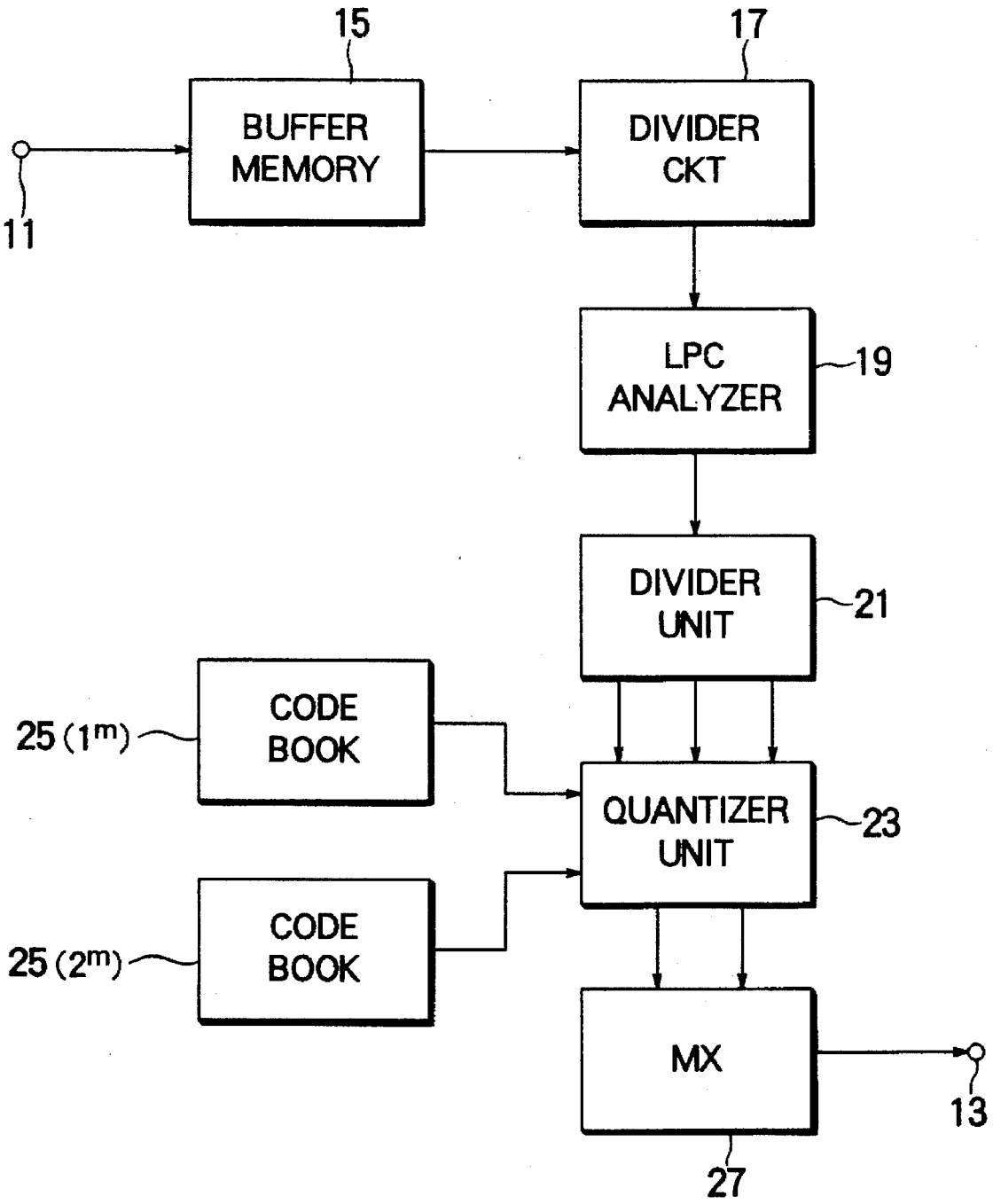
FIG. 1 is a block diagram of a speech parameter encoding device according to a first embodiment of the instant invention.

Referring to FIG. 1, the description will begin with a speech parameter encoding device according to a first embodiment of the present invention. The speech parameter encoding device has a device input terminal 11 and a device output terminal 13. The device input terminal 11 is supplied with an input speech or voice signal. In the manner which will be described in the following, the speech parameter encoding device encodes the input speech signal into an output code signal of a low bit rate, such as 4.8 kb/s, and delivers the output code signal to the device output terminal 13. The input speech signal is divisible into frame signals having a common frame length which is selected between 30 and 40 milliseconds.

Connected to the device input terminal 11, a buffer memory 15 is loaded with each frame signal. Connected to the buffer memory 15, a subframe divider 17 divides the frame signal into subframe signals of a plurality of subframes, each having a predetermined subframe length selected between 5 and 8 milliseconds. The input speech signal is featured by spectrum characteristics.

A combination of the buffer memory 15 and the divider 17 serves as a dividing circuit for dividing each frame signal of the input speech signal directly into a plurality of subframe signals. It should be noted that a plurality of subframe signals may be included in each subframe and may collectively be referred to afresh as a subframe signal.

Supplied from the divider 17 successively with the subframe signals, an LPC analyzer unit 19 subjects the subframe signals to LPC analysis in the manner known in the art to calculate, for or in connection with at least one of the subframe signals of each frame signal that is selected as a predetermined subframe signal, spectrum parameters or LPC coefficients representative of the spectrum characteristics up to a predetermined degree P, such as a tenth degree, and to produce a spectrum parameter signal representative of the spectrum parameters. When the frame length and the subframe length are 40 and 8 milliseconds long, respectively each frame signal is divided into first through fifth subframe signals. It is possible to select the fifth subframe signal as the predetermined subframe signal.

The spectrum parameters may be LSP (line spectrum pair) parameters which can be calculated in accordance with the Sugamura et al paper mentioned heretobefore. It is possible to calculate the LSP parameters by selecting the first, the third, and the fifth subframe signals as predetermined subframe signals. In this event, the LSP parameters of the second subframe signal are calculated by linear interpolation between the LSP parameters calculated for the first and the third subframe signals. For the fourth subframe signal, the LSP parameters are calculated by linear interpolation between the LSP parameters of the third and the fifth subframe signals.

Connected to the LPC analyzer unit 19, a dividing unit 21 divides the spectrum parameters of at least one predetermined subframe signal into a predetermined region number M of parameter regions, which are first through M-th parameter regions. Preferably, the predetermined region number is determined so as to minimize an amount of calculation and a memory capacity. For example, the LSP parameters of the predetermined subframe signal are divided into a first or lower parameter region, a second or middle parameter region, and a third or higher parameter region with the LSP parameters of the first through the third degrees, of the fourth through the sixth degrees, and of the seventh through the tenth degrees grouped in the first through the third parameter regions. In connection with the dividing unit 21, the degrees (the first to the P-th) of spectrum parameters will alternatively be called spectrum parameter degrees. Divided from the predetermined subframe signal, each parameter region includes those of the spectrum parameters which have particular ones of the spectrum parameter degrees, such as only three (the first to the third or the fourth to the sixth) or four (the seventh to the tenth) spectrum parameter degrees among the first to the tenth spectrum parameter degrees, and which will be referred to as one of first to M-th sets of sub-parameters, depending on the circumstances. In each of such sub-parameter sets, the sub-parameters are afresh assigned with sub-parameter degrees which are less in number, such as either first to third or first to fourth (i.e., the renumbered seventh to tenth) sub-parameter degrees, than the spectrum parameter degrees.

Supplied from the dividing unit 21 with the spectrum parameters calculated for the predetermined subframe signal and divided into the first through the M-th parameter regions, a spectrum parameter or SPC parameter quantizer unit 23 quantizes the spectrum parameters into quantized codes of a predetermined common quantized bit number. The quantizer unit 23 is connected to preliminarily designed vector quantization code books or, briefly, vector code books, a plurality of stages in number for an m-th parameter region, where m is variable between 1 and M, both inclusive. In the illustrated example, the stages are two in number. As a consequence, the vector code books are first and second code books 25($1^m$) and 25($2^m$) for the m-th parameter region. Such vector code books are a product of the region number and the number of stages in total.

Each vector code book defines a plurality of code vectors for the spectrum parameters of the m-th parameter region. Each quantized code represents a quantized value decided by a linear combination of the code vectors selected from the vector code books so as to minimize a quantization distortion in the manner which will presently become clear.

For the LSP parameters of the m-th parameter region, the quantized value is represented by $LSP'(i)^m$, where i represents an intraregion degree number in each parameter region. More particularly, i is a variable between 1 and I, both inclusive, where I represents a maximum degree number which depends on the m-th parameter region and is equal to three in each of the first and the second parameter regions and equal to four in the third parameter region. For example, LSP(10) is identical with $LSP(4)^3$, where 10 is a region degree number serially assigned to the LSP parameters calculated in connection with the predetermined subframe signal and where LSP(p) represents the LPC coefficient before quantization, p representing an intrasubframe degree number variable between 1 and P.

The first and the second code books define B1 bits and B2 bits, where each of B1 and B2 represents a predetermined integer. For the m-th parameter region, a k-th code vector of the first code book is represented by $c(1k^m, i)$ and a j-th code vector of the second code book, by $c(2j^m, i)$. The quantized value is now represented as:

$$LSP'(i)^m=[c(1k^m, i)+c(2j^m, i)]/2. \quad (1)$$

With such quantized values, the quantized codes may be subjected to a quantization distortion D which can be represented by a distance measure as:

$$D=\sum_{i=1}^{I} c(i)b(i)\times(LSP(i)^m-[c(1k^m,i)+c(2j^m,i)]/2)^2,$$

where c(i) and b(i) represent first and second weighting factors which will presently be defined. For use in Equation (1), the selected vectors are selected or retrieved, so as to minimize the quantization distortion for the m-th parameter region, from the code vector stored in the code books as stored vectors.

The weighting factors are given by:

$$c(i)=1.0 \text{ or } c(i)=0.8,$$

and $$b(i)=1/[LSP(i)^m-LSP(i-1)^m]+1/[LSP(i+1)^m-LSP(i)^m].$$

For the first weighting factor, the value of 1.0 is used when the intrasubframe degree number is one of 1 through 8, both inclusive. The value of 0.8 is used when the intrasubframe degree number is 9 or 10. For the second weighting factor, $LSP(\mathbf{0})^m$ is equal to zero. The value of $LSP(I+1)^m$ of a parameter region is equal to $LSP(\mathbf{1})^m$ of a higher parameter region, if available. $LSP(P+1)^m$ is given a predetermined number which may be, for example, $\pi$.

The second weighting factor is used in order to evaluate with a small evaluation weight a distortion component resulting from the spectrum parameter which has as a region end parameter the intraregion degree number equal to the maximum degree number. Details are described in the Laroia et al paper mentioned hereinabove.

The code vectors searched for or retrieved by a full search from all combinations of the stored vectors for use in Equation (2). More specifically, the combinations are $2^{B1}\times 2^{B2}$ in number. With regard to each combination, the quantization distortion is evaluated in accordance with Equation (2). At least one combination is selected. The selected vectors are retrieved as regards all parameter regions.

It is possible to determine the stored vectors by training the vector code books by the use of a great number of LSP parameters as training parameters. Training is possible in the manner taught in the Linde et al paper mentioned hereinabove. Incidentally, the spectrum parameter quantizer unit 23 is implemented by a microprocessor.

The selected vectors are indicated by indexes $I(\mathbf{1}k^m)$ and $I(\mathbf{2}j^m)$ indicative of the stored vectors in each of the vector code books. The quantizer unit 23 delivers the indexes to a multiplexer (MX) 27. In this manner, the quantized codes are calculated from the linear combination of the selected vectors. The multiplexer 27 supplies the device output terminal 13 with the output code signal.

Figure 2:
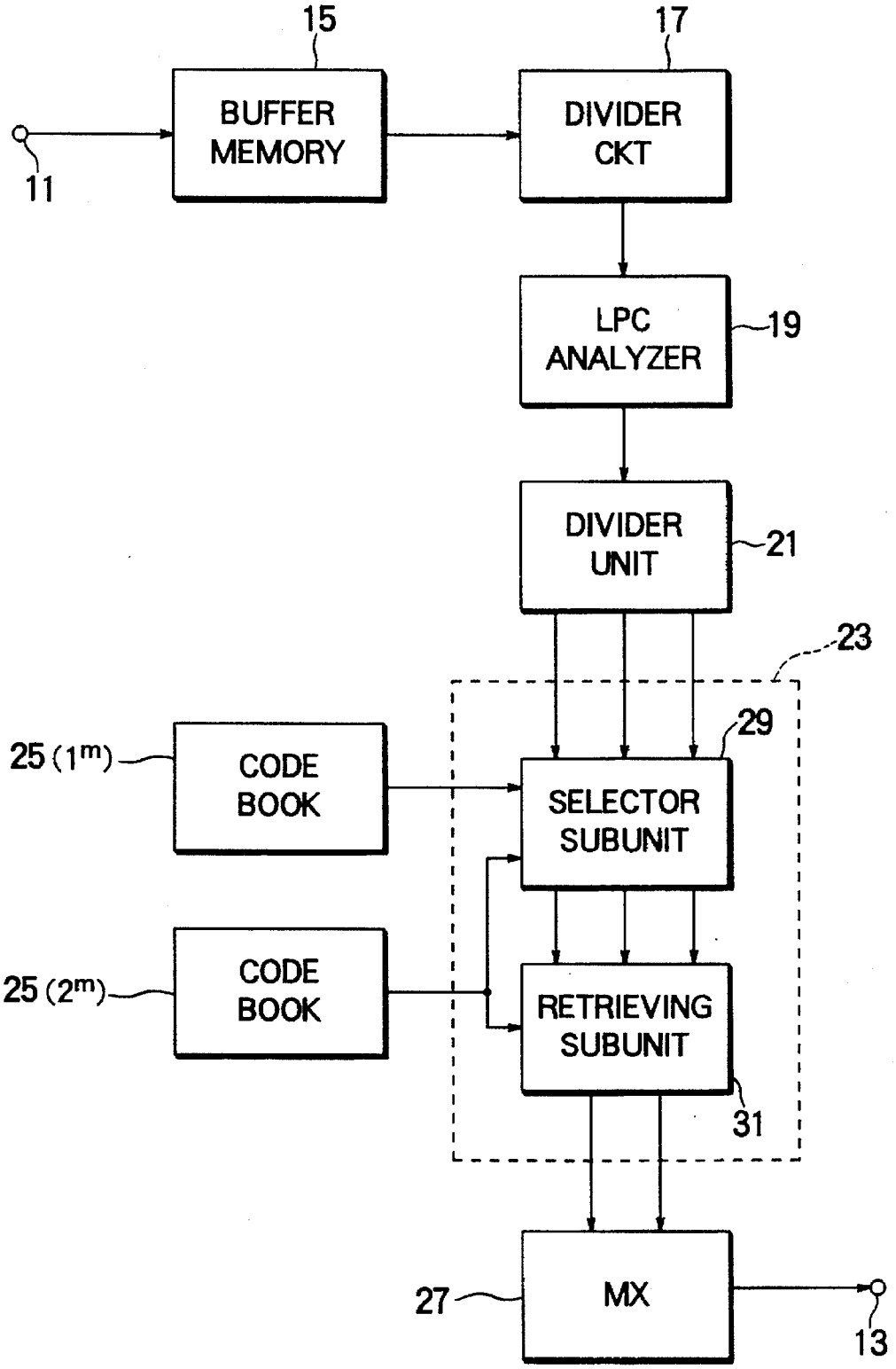
FIG. 2 is a block diagram of a speech parameter encoding device according to a second embodiment of this invention.

Referring to FIG. 2, the description will proceed to a speech parameter encoding device according to a second embodiment of this invention. Similar parts are designated by like reference numerals and are similarly operable with likewise named signals.

In FIG. 2, the spectrum parameter or the LSP parameter quantizer unit 23 is implemented again by a microprocessor and comprises a preliminary selector unit 29. Connected to the vector code books, such as the first and the second code books $\mathbf{25}(\mathbf{1}^m)$ and $\mathbf{25}(\mathbf{2}^m)$, the selector unit 29 selects candidate vectors from the code vectors stored in at least one of the code books as primary stored vectors. The candidate vectors are selected in succession according to an order which minimizes a simplified quantization distortion D' defined in the m-th parameter region by:

$$D'=\sum_{i=1}^{I} c(i)b(i)\times[(LSP(i^m)-c(k^m,i)]^2, \tag{3}$$

where $k^m$ represents the index given to each of the primary stored vectors. In the illustrated example, such three candidate vectors are selected. In contrast to the simplified quantization distortion, a name of a regular quantization distortion will be given to the quantization distortion D defined by Equation (2).

The quantizer unit 23 further comprises a search or retrieving unit 31. Connected to the second code book in the illustrated example and supplied from the selector unit 29 with the candidate vectors, the search unit 31 retrieves the indexes, such as $I(\mathbf{1}k^m)$ and $I(\mathbf{2}j^m)$, of the selected vectors which minimizes the regular quantization distortion.

Figure 3:
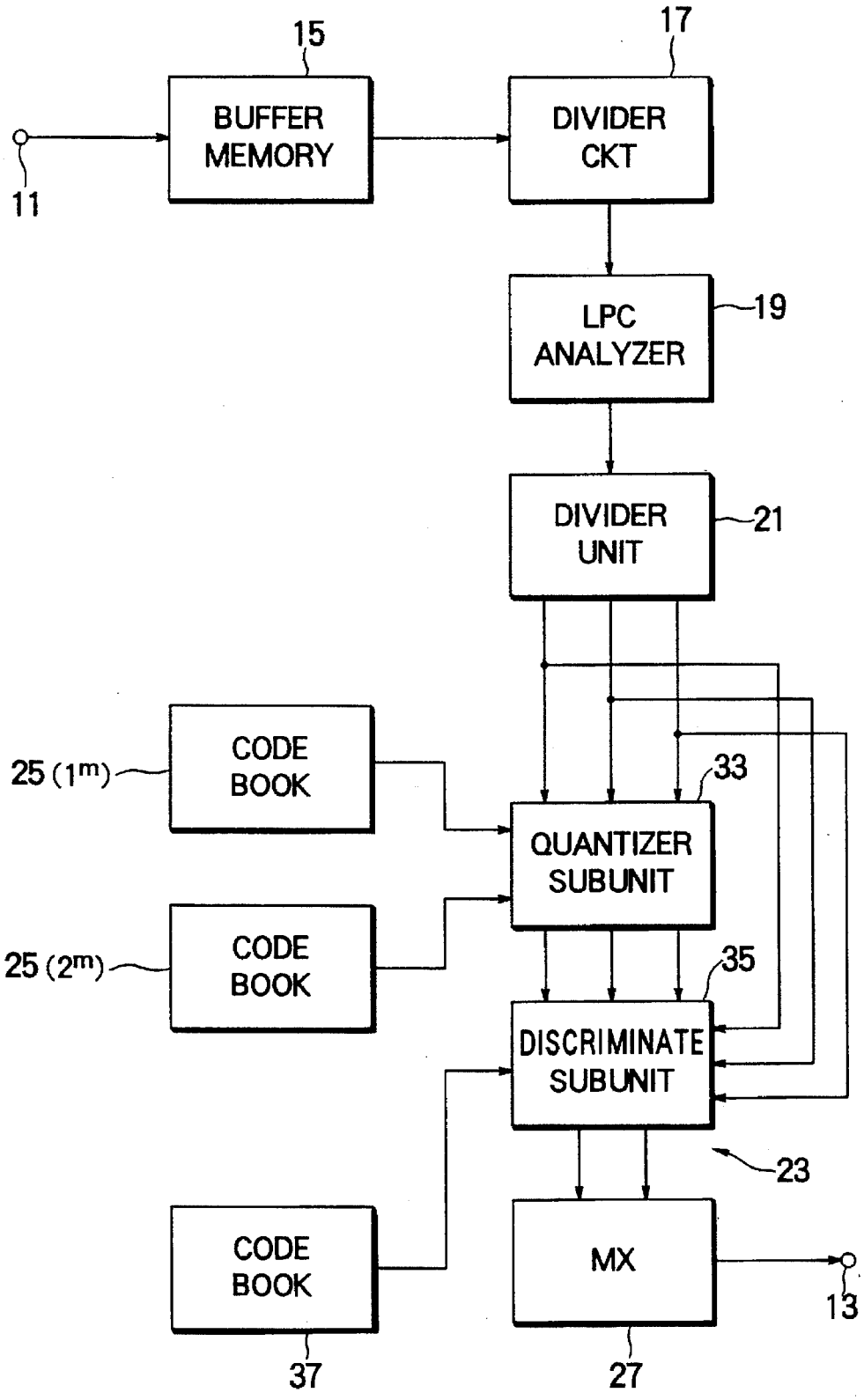
FIG. 3 is a block diagram of a speech parameter encoding device according to a third embodiment of this invention.

Referring to FIG. 3, attention will be directed to a speech parameter encoding device according to a third embodiment of this invention. Once more, similar parts are designated by like reference numerals and are similarly operable with likewise named signals.

The spectrum parameter or LSP parameter quantizer unit 23 is implemented by a microprocessor and comprises a quantizer subunit 33 which is operable substantially like the quantizer unit 23 described in connection with FIG. 1. Connected to the vector code books, such as the first and the second code books $\mathbf{25}(\mathbf{1}^m)$ and $\mathbf{25}(\mathbf{2}^m)$, the quantizer subunit 33 selects at least one vector combination of the selected vectors as a combination candidate for each of the parameter regions that minimizes the quantization distortion defined by Equation (2). In the example being illustrated, the quantizer subunit 33 delivers the vector combination to one of three signal lines drawn therefrom.

The quantizer unit 23 further comprises a discriminator subunit 35. For use in cooperation with the discriminator subunit 35, an interpolation code book 37 is preliminarily loaded, in connection with the subframe signals, with an eta coefficient $\eta$ which will shortly become clear.

It will be presumed in the manner exemplified in the foregoing that the LPC analyzer unit 19 calculates the spectrum parameters in connection with the fifth subframe signal alone in each frame signal. It should be noted that the spectrum parameters are calculated in this manner not only in connection with one of such frame signals that is currently processed as a current frame signal but also in connection with the frame signal which one frame length precedes the current frame signal as a previous or preceding frame signal. As a result, the quantizer subunit 33 quantizes the spectrum parameters calculated from the fifth subframe signals of the current and the previous frame signals.

Using the vector combination selected for such fifth subframe signals, the quantizer subunit 33 calculates in accordance with Equation (1) the quantized values $LSP'(i)_{5c}$ and $LSP'(i)_{5p}$, where suffixes 5c and 5p represent the fifth subframe signals of the current and the previous frame signals. In FIG. 3, these quantized values are delivered to the discriminator subunit 35 through two remaining ones of the signal lines drawn to the discriminator subunit 35.

Using the quantized values supplied from the quantizer subunit 33 and the spectrum parameters supplied from the dividing circuit 21 in connection with the parameter regions and referring to the interpolation code book 37, the discriminator subunit 35 interpolates, as interpolated values, the quantized values for other subframe signals, such as the first through the fourth subframe signals, of the current frame signal. On interpolating an interpolated value $LSP'(i)_C$ for a center or intermediate subframe signal of the current frame signal, the discriminator subunit 35 calculates as follows:

$$LSP'(i)_C=(1-\eta)LSP'(i)_{5p}+\eta LSP'(i)_{5c}, \tag{4}$$

where $\eta$ represents the eta coefficient stored in the interpolation code book 37. Similar to Equation (4), interpolated values $LSP'(i)_{1c}$ and $LSP'(i)_{2c}$ for the first and the second subframe signals are calculated as follows:

$$LSP'(i)_{1c}=0.6LSP'(i)_{5p}+0.4LSP'(i)_C,$$

and $$LSP'(i)_{2c}=0.2LSP'(i)_{5p}+0.8LSP'(i)_C.$$

For the third and the fourth subframe signals of the current frame signal, interpolated values $LSP'(i)_{3c}$ and $LSP'(i)_{4c}$ are calculated in accordance with:

$$LSP'(i)_{3c}=0.8LSP'(i)_C+0.2LSP'(i)_{5c},$$

and $$LSP'(i)_{4c}=0.4LSP'(i)_C+0.6LSP'(i)_{5c}.$$

Thereafter, the discriminator subunit 35 calculates an accumulated distortion D" of the quantization distortion in accordance with an equation:

$$D''=\sum_{s=1}^{5}\sum_{m=1}^{M}E(s^m), \tag{5}$$

where s represents an ordinal number assigned to each subframe signal. In Equation (5), $$E(s^m)=\sum_{i=1}^{I}c(i)b(i)\times[LSP(i^m,s)-LSP'(i^m,s)]^2. \tag{6}$$

The interpolation code book 37 is additionally stored with the code vectors as interpolation vectors and is trained in accordance with the Linde et al paper referred to above with regard to the vector code books described in conjunction with FIG. 1. The discriminator subunit 35 calculates Equations (5) and (6) for the candidate or candidates and for the interpolation vectors and selects for delivery to the multiplexer 27 a candidate combination of one of the candidates and ones of the interpolation vectors that minimize Equations (5) and (6). Incidentally, it is possible to store interpolation patterns in the interpolation code book 37 in place of the eta coefficients and of the interpolation vectors.

In the manner described throughout the foregoing, spectrum parameters representative of the spectrum characteristics of an input speech signal are quantized in accordance with this invention by calculating the spectrum parameters in connection with at least one of subframe signals of a frame signal, by dividing the spectrum parameters into parameter regions, and by quantizing the spectrum parameters of the parameter regions by the use of code vectors supplied from vector code books which are of a plurality of stages in number for each of the parameter regions. It is therefore possible to reduce an amount of calculation and a memory capacity and to quantize the spectrum parameters with a smallest possible number of bits and with an improved speech quality.

While this invention has thus far been described in specific conjunction with a few preferred embodiments, it will now be readily possible for one skilled in the art to put this invention into practice in various other manners. Examples will be described in the following.

The spectrum parameters need not necessarily be the LSP parameters but may be other known parameters. Besides the distance measure defined by Equation (2), a different known distance measure may be used in designing and retrieving the vector code books. It is possible to use the interpolation code book 37 in common to a plurality of subframe signals. Alternatively, such interpolation code books may be optimized for use in connection with the respective subframe signals. In this event, the interpolation code books may be combined into a code book of a matrix structure. Such a matrix code book is described in the Tsao et al paper mentioned heretobefore and may be trained and retrieved by the use of any known distance measure.

The vector parameter quantizer unit 23 is used to carry out the full search. A tree-type search, a lattice-type search, a multistage-type search may, however, be resorted to in order to reduce an amount of calculation necessary for retrieval of the code vectors stored in the vector code books.

By the LSP parameter quantizer unit 23, the vector code books are searched for in consideration of Equation (2) so that the quantizer unit 23 may produce in FIGS. 1 through 3 a combination candidate which minimizes Equation (2). A plurality of combination candidates may, however, be produced with regard to each parameter region. In this event, the accumulated distortion should be calculated in connection with all of the parameter regions, instead of Equation (5), according to a different equation:

$$Ds=\sum_{m=1}^{M}E(s^m), \tag{7}$$

where $E(s^m)$ is calculated in accordance with Equation (6). Furthermore, the quantized values are checked in connection with the first through the P-th degrees whether they satisfy inequalities:

$$LSP'(1)<LSP'(2)<\ldots<LSP'(i)<LSP'(i+1)<\ldots<LSP'(P).$$

If they satisfy the inequalities, only one of the combination candidates may be produced that minimizes Equation (7). This may unavoidably increase the amount of calculation. This, however, improves capabilities of the speech parameter encoding device.

By the spectrum parameter quantizer unit 23, the quantized values are calculated by making the LPC analyzer unit 19 analyze one or three of the subframe signals to produce the LSP parameters. For this LPC analysis, it is possible to use a different number of subframe signals.

What is claimed is:

1. A speech parameter encoding device including a dividing circuit for dividing each frame signal of an input speech signal into a plurality of subframe signals, said speech parameter encoding device comprising:

a spectrum parameter calculating unit for calculating spectrum parameters for at least one of said subframe signals up to a predetermined spectrum parameter degree;

a dividing unit for dividing said spectrum parameters into sets of sub-parameters, with the sub-parameters of each set assigned sub-parameter degrees which are less in number than said predetermined spectrum parameter degree;

vector code books, a plurality of stages in number, each code book defining a plurality of code vectors for each set of said sub-parameters;

a quantizing unit for quantizing said sub-parameters into quantized codes by selecting vectors from said code books with each of said quantized codes calculated from a linear combination of said selected code vectors; and an output unit for producing said quantized codes as an output code signal.

2. A speech parameter encoding device as claimed in claim 1, wherein:

each of said code books is loaded, for each of said sub-parameters, with the code vectors and said code vectors are given consecutive indexes;

said quantizing unit producing, as said quantized codes, the indexes given to said selected code vectors.

3. A speech parameter encoding device as claimed in claim 1, wherein said quantizing unit selects said code vectors so s to minimize a quantization distortion calculated by using said linear combination.

4. A speech parameter encoding device as claimed in claim 3, wherein said quantizing unit minimizes said quantization distortion by weighting said sub-parameters more heavily when said sub-parameters are perceptionally more important.

5. A speech parameter encoding device as claimed in claim 1, wherein said spectrum parameter calculating unit calculates said spectrum parameters for one of said subframe signals alone in each frame signal.

6. A speech parameter encoding device as claimed in claim 1, wherein:

said dividing circuit divides each frame signal of said input speech signal into said subframe signals with an odd number used as said plurality to produce consecutively numbered subframe signals;

said spectrum parameter calculating unit calculating said spectrum parameters with each of odd-numbered subframe signals used as said one of subframe signals.

7. A speech parameter encoding device as claimed in claim 1, wherein said quantizing unit comprises:

a selecting subunit for preliminarily selecting, from the code vectors stored in the code book of at least one of said stages, candidate vectors which minimize in successive orders a simplified quantization distortion; and a search subunit for calculating a regular quantization distortion by vector combination of said candidate vectors to select one of said vector combinations and to produce, as said quantized codes, indexes given to the selected vectors used in said one of vector combinations.

8. A speech parameter encoding device as claimed in claim 1, wherein:

said speech parameter encoding device further comprises an interpolation code book loaded with interpolation vectors;

said quantizing unit comprising:

a quantizing subunit for quantizing said sub-parameters in said at least one of subframe signals of one frame signal to produce, as a combination candidate, one of linear combinations of the selected code vectors that minimizes a quantization distortion calculated in connection with said at least one of subframe signals; and a discriminator subunit responsive to said combination candidate for interpolating interpolated combinations of said interpolation vectors in connection with others of said subframe signals of said one frame signal and for calculating quantization distortions in connection with said others of subframe signals to minimize an accumulated distortion of the quantization distortions calculated in connection with said at least one and said others of subframe signals and to produce, as said quantized codes, said combination candidate and the interpolation vectors used in said interpolated combinations.

* * * * *